US010704401B2

(12) United States Patent
Aiello et al.

(10) Patent No.: US 10,704,401 B2
(45) Date of Patent: Jul. 7, 2020

(54) ROTOR WITH RELIEF FEATURES AND ONE-SIDED LOAD SLOTS

(71) Applicant: United Technologies Corporation, Farmington, CT (US)

(72) Inventors: Nicholas Aiello, Middletown, CT (US); James Cosby, Glastonbury, CT (US)

(73) Assignee: Raytheon Technologies Corporation, Farmington, CT (US)

( * ) Notice: Subject to any disclaimer, the term of this patent is extended or adjusted under 35 U.S.C. 154(b) by 22 days.

(21) Appl. No.: 16/100,615

(22) Filed: Aug. 10, 2018

(65) Prior Publication Data

US 2018/0363480 A1 Dec. 20, 2018

Related U.S. Application Data

(63) Continuation of application No. 13/314,121, filed on Dec. 7, 2011, now Pat. No. 10,107,114.

(51) Int. Cl.
*F01D 5/32* (2006.01)
*F01D 5/30* (2006.01)

(52) U.S. Cl.
CPC ..... *F01D 5/32* (2013.01); *F01D 5/3038* (2013.01); *Y10T 29/49321* (2015.01)

(58) Field of Classification Search
CPC ..... F01D 5/066; F01D 5/3023; F01D 5/303; F01D 5/3038; F01D 5/3046; F01D 5/3069; F01D 5/32; Y10T 29/49321
USPC .... 416/214 R, 214 A, 215, 216, 220 R, 248; 29/889.21
See application file for complete search history.

(56) References Cited

U.S. PATENT DOCUMENTS

| | | | | |
|---|---|---|---|---|
| 4,033,705 A | | 7/1977 | Luebering | |
| 4,432,697 A | * | 2/1984 | Miura | F01D 5/06 415/199.5 |
| 4,451,204 A | * | 5/1984 | Pask | F01D 11/006 416/193 A |
| 4,907,944 A | | 3/1990 | Kroger et al. | |
| 5,071,313 A | | 12/1991 | Nichols | |
| 5,112,193 A | | 5/1992 | Greer et al. | |
| 5,435,694 A | | 7/1995 | Kray et al. | |
| 5,522,706 A | | 6/1996 | Mannava et al. | |
| 6,152,698 A | * | 11/2000 | Gregg | F01D 5/3038 29/407.05 |

(Continued)

FOREIGN PATENT DOCUMENTS

| | | |
|---|---|---|
| EP | 1170463 | 1/2002 |
| EP | 1801355 | 6/2007 |

(Continued)

OTHER PUBLICATIONS

European Search Report for Application No. 12195723.7 dated Feb. 24, 2017.

*Primary Examiner* — David E Sosnowski
*Assistant Examiner* — Alexander A White
(74) *Attorney, Agent, or Firm* — Carlson, Gaskey & Olds, P.C.

(57) ABSTRACT

An exemplary turbomachine rotor assembly includes a pair of spaced rails that extend around a cylindrical surface to define a rotor hub. The rails define a space for receiving blades. Load slots are formed in one of the rails. A relief feature is formed in an opposite surface of an opposing rail. The load slots and relief feature utilized to move at least one of the blades into the space.

19 Claims, 4 Drawing Sheets

(56) References Cited

U.S. PATENT DOCUMENTS

| | | | | |
|---|---|---|---|---|
| 6,464,463 | B2 * | 10/2002 | Yvon Goga ..... | F01D 5/3038<br>416/215 |
| 6,592,330 | B2 | 7/2003 | Leeke et al. | |
| 2001/0055527 | A1 | 12/2001 | Yvon Goga et al. | |
| 2011/0116933 | A1 * | 5/2011 | Aiello ..... | F01D 5/3038<br>416/215 |

FOREIGN PATENT DOCUMENTS

| | | |
|---|---|---|
| EP | 2333243 | 6/2011 |
| EP | 2549060 | 1/2013 |

* cited by examiner

ROTOR WITH RELIEF FEATURES AND ONE-SIDED LOAD SLOTS

CROSS-REFERENCE TO RELATED APPLICATIONS

This application is a continuation of U.S. patent application Ser. No. 13/314,121, which was filed on 7 Dec. 2011 and is incorporated herein in its entirety.

BACKGROUND

This disclosure relates to a tangential compressor or turbine rotor having relief features formed on one of the two rails in the rotor and load slots formed on the other of the two rails in the rotor.

Turbomachines, such as gas turbine engines, are known. Turbomachines typically include a compressor that compresses air and delivers it downstream into a combustion section. The compressed air is mixed with fuel and combusted. The products of combustion pass downstream through a turbine. The compressor and turbine include rotors. Arrays of removable blades are mounted to the rotors.

When mounting the removable blades to the rotor, the removable blades are moved into load slots formed in the two opposed rails in the rotor. The load slots are formed at circumferentially spaced locations. Each of the load slots extend radially from radially inward facing surfaces of the rails to radially outward facing surfaces of the rails. During installation, the relatively wide root of each individual blade is moved into the load slots. The blades are then slid into a mount space between the rails, at locations that are circumferentially offset from the load slots. The blades are moved circumferentially until they fill the entire space. In addition, locks are positioned at several circumferentially spaced locations between the blades to take up remaining space and inhibit the blades from moving circumferentially relative to the rotor.

In the prior art, circumferentially aligned pairs of load slots are formed in the opposing rails to accommodate the roots of the blades. Some prior art designs may utilize a single load slot formed in the rail that faces the compressor rather than a circumferentially aligned pair of load slots. The single load slot is much larger than each of the load slots in the circumferentially aligned pairs. The larger load slot may undesirably accelerate fatigue in the rail.

SUMMARY

An exemplary turbomachine rotor assembly includes a pair of spaced rails that extend around a cylindrical surface to define a rotor hub. The rails define a space for receiving blades. Load slots are formed in one of the rails. A relief feature is formed in an opposite surface of an opposing rail. The load slots and relief feature are utilized to move at least one of the blades into the space.

Another example turbomachine rotor assembly includes a pair of spaced rails that extend around a cylindrical surface to define a rotor hub. The rails define a space for receiving blades. Blade load slots are formed in one of the rails. The blade load slots extend from an outwardly facing surface of the one of the rails to an inwardly facing surface of the other of the rails. Relief features are formed on an underside of the opposed rail. The relief feature is circumferentially aligned with the blade load slots. The blades are moved into the space through the blade load slots and the relief feature. The blades are then moved circumferentially to be adjacent to other blades.

A rotor assembly method includes moving a blade into a space between a pair of spaced rails that extend around a cylindrical surface to define a rotor hub. The method then moves the blade circumferentially to an installed position within the rotor hub. The blade moves through a blade load slot formed on one of the spaced rails, and through a relief feature formed on the other of the spaced rails.

BRIEF DESCRIPTION OF THE DRAWINGS

The various features and advantages of the disclosed examples will become apparent to those skilled in the art from the detailed description. The figures that accompany the detailed description can be briefly described as follows.

DETAILED DESCRIPTION

Figure 1:
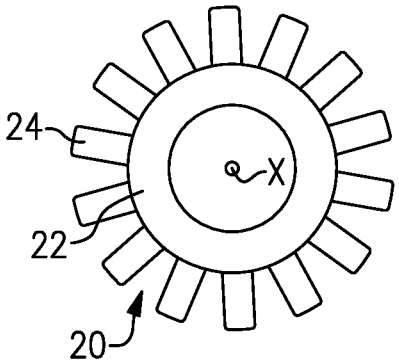
FIG. 1 shows the mounting of a blade within a turbine rotor.

FIG. 1 schematically shows a turbine rotor 20 for use in a gas turbine engine or another type of turbomachine. The rotor 20 incorporates a rotor hub 22, and an array of blades 24 spaced about the circumference of the rotor hub 22. The rotor hub 22 is centered for rotation about a central axis X, as is known. While the example embodiments will be described with reference to a turbine rotor, other examples have application in a compressor rotor.

Figure 2:
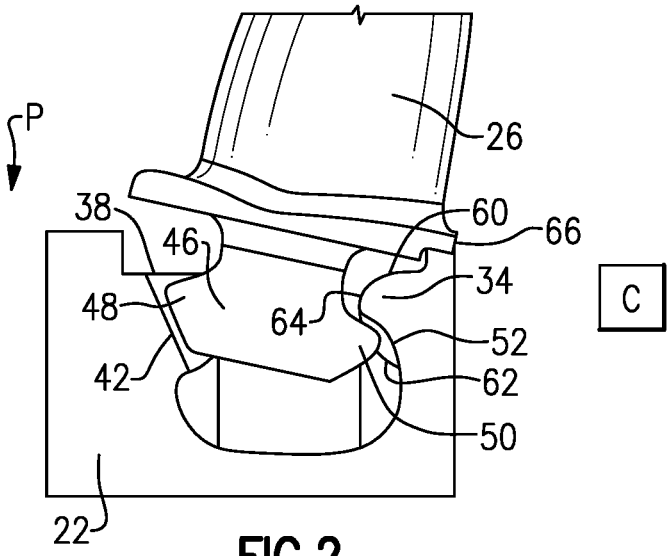
FIG. 2 shows a portion of the FIG. 1 turbine rotor and a blade insertion step.
Figure 3:
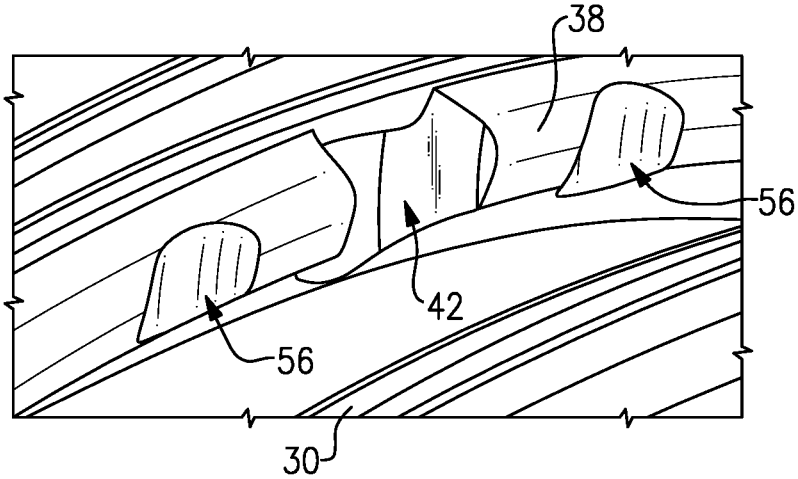
FIG. 3 shows a perspective view of a portion of the FIG. 1 turbine rotor.
Figure 4:
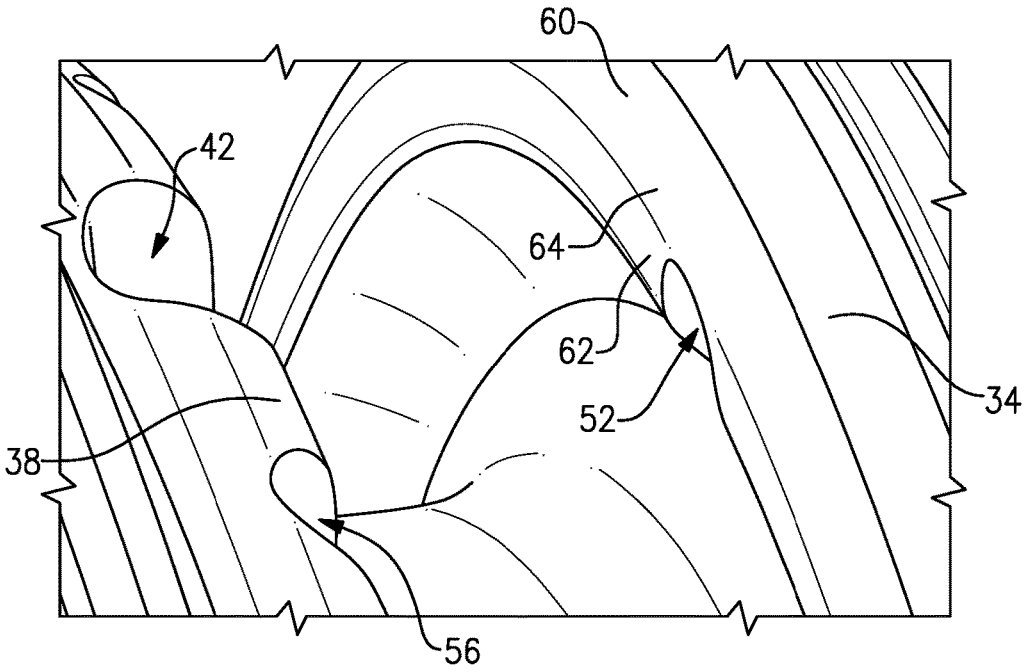
FIG. 4 shows another perspective view of a portion of the FIG. 1 turbine rotor.
Figure 5:
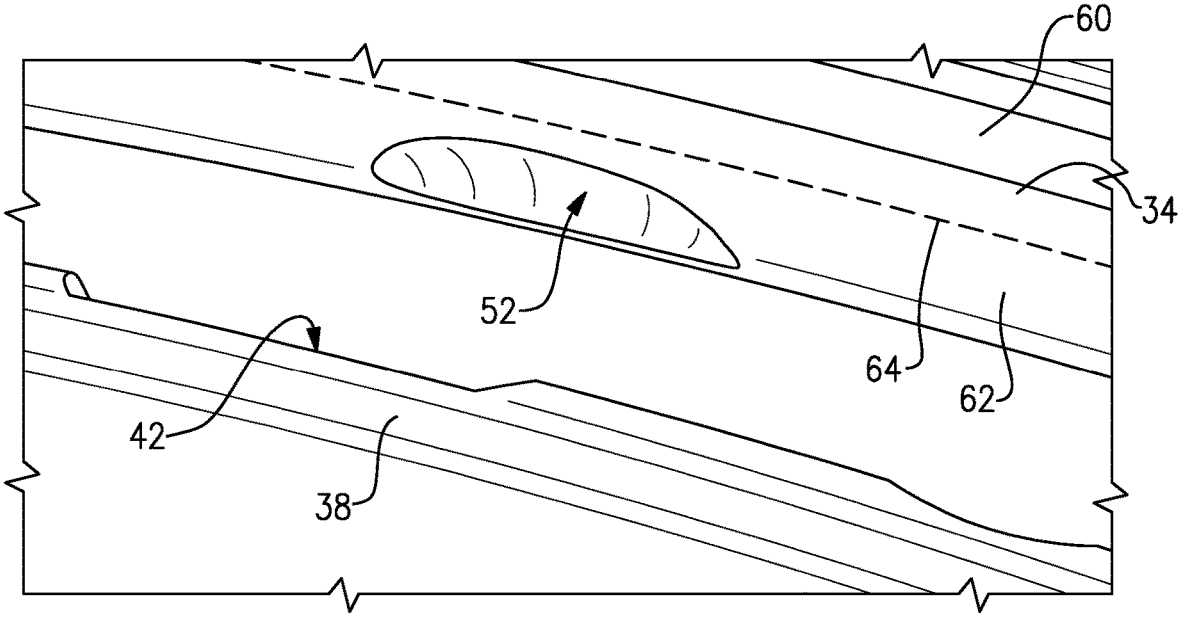
FIG. 5 shows yet another perspective view of a portion of the FIG. 1 turbine rotor.

As shown in FIGS. 2-4, a blade 26 in the array 24 is mounted between rear rail 34 and forward rail 38, through a load slot 42. The rear rail 34 and forward rail 38 together make up a pair of spaced rails.

The load slot 42 is formed in the "cold side" forward rail 38, and is not formed in the "hot side" rear rail 34. The "cold side" forward rail 38 may be further from a combustion section C than the "hot side" rear rail 34 when the rotor 20 is mounted within a gas turbine engine. While the "hot side" will typically face toward the combustion section, in certain applications, and at certain turbine stages, it is possible for the opposed "upstream" side of the turbine to be the hot side. Further, when the features of this disclosure are applied to a compressor rotor, the hot side may also be facing toward the combustion section, or away, depending on the particular application.

As shown, the blade has a root section 46 having a forward ear 48, which is received under the forward rail 38, and a rear ear 50, which moves through the load slot 42.

A relief feature 52 is formed in the underside of the rear rail 34. The relief feature 52 facilitates movement of the root section 46, and particularly the rear ear 50, through the load slot 42.

Due to the relief feature 52, the load slot 42 does not need to be as large. That is, the load slot 42 can be made shallower because of the relief feature 52 accommodating some of the root section 46 during installation.

The load slot 42 is formed in the forward rail 38, and there is no corresponding slot in the rear rail 34. The relief feature 52, however, does correspond to the circumferential location of the load slot 42. In addition, as shown in FIG. 2A, the forward rail 38 is formed with lock slots 56, while the rear rail 34 does not have any such lock slots 56.

The rear rail 34 includes a radially outward facing surface 60 and a radially inward facing surface 62 that meet at an interface 64. The example relief feature 52 is formed entirely within the radially inward facing surface 62 and does not extend past the interface 64. That is, there is no portion of the relief feature 52 extending into the radially outward facing surface 60. In this example, the radially outward facing surface 60 is continuous and uninterrupted about the entire circumference of the rear rail 34. Also, in this example, the relief feature 52 is concave.

The load slot 42, in contrast to the relief feature 52, does extend from an outwardly facing surface of the forward rail 38 to an inwardly facing surface of the forward rail 38.

Figure 6:
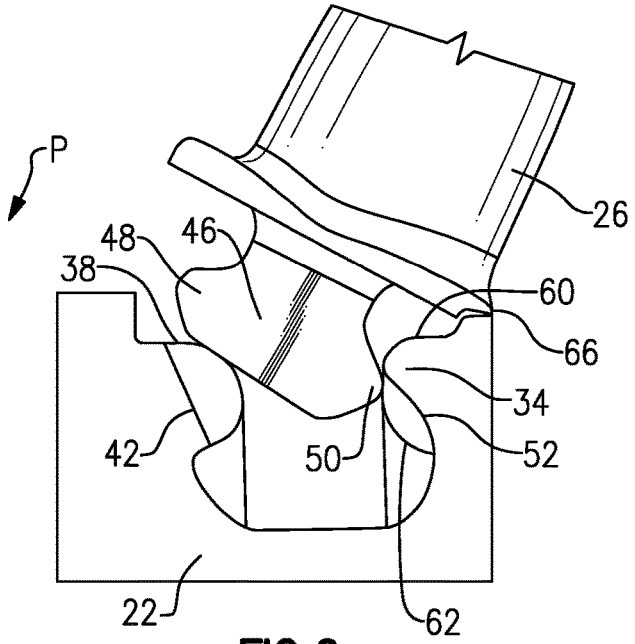
FIG. 6 shows a portion of the FIG. 1 turbine rotor and a blade insertion step that is earlier than the blade insertion step shown in FIG. 2.

As shown in FIGS. 2 and 6, when initially mounting the blade 26 within the rotor hub 22, the forward ear 48 is rotated into the load slot 42 about a back edge 66 of the blade 26 in a direction P. The relief feature 52 provides room for the rear ear 50 of the root section 46. The forward ear 48 may be "hooked" under a ladder seal (not shown) during installation.

After the blade 26 is fully rotated into the load slot 42, the blade 22 can be moved circumferentially, with the ears 48 and 50 remaining underneath portions of the forward rail 38 and rear rail 34, such that the blades 26 can be aligned and positioned across the entire circumference of the rotor 20 (see FIG. 1). In applications, there may be two load slots 42 spaced by 180° about the circumference of the rotor hub 22. Essentially, the forward rail 38 and rear rail 34 define a space to receive and mount the blades 26.

Figure 7:
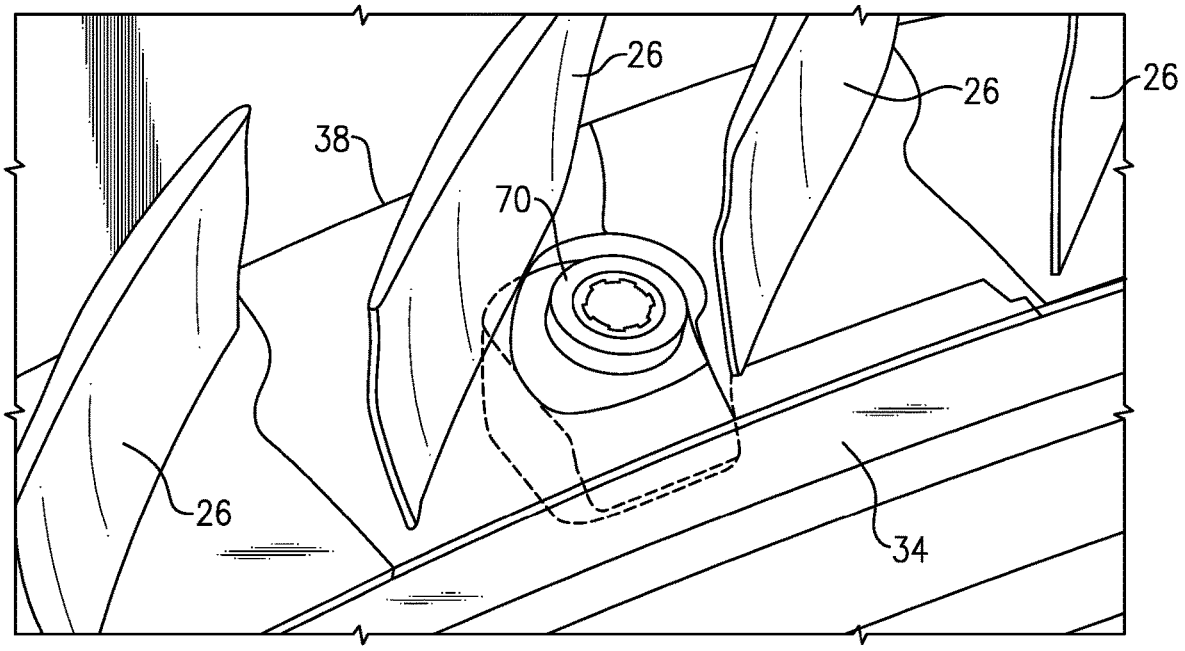
FIG. 7 shows lock members of the FIG. 1 turbine rotor.

FIG. 7 shows another detail, wherein blades 26 have been mounted between the forward rail 38 and rear rail 34. In addition, other blades 26 are shown, which have a space to surround a lock member 70.

Lock members 70 are typically positioned on each side of a pair of blades 26 that sit circumferentially closest to the load slot 42 when the rotor 20 is fully assembled with blades 26. In addition, other lock members 70 are provided at circumferentially spaced locations.

In this example, there are a total of eight locks, spaced evenly about the circumference of the rotor 20, but with two sets of locks secured on each side of the load slot 42.

Figure 8:
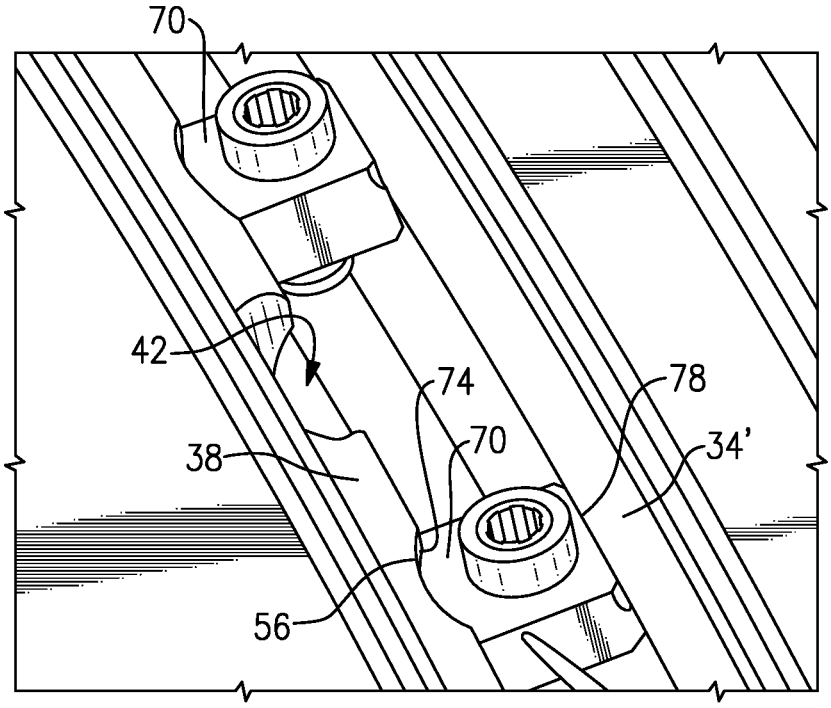
FIG. 8 shows another feature of the lock members.

As shown in FIG. 8, the locks 70 are received with a curved side 74 sitting in the lock slot 56, and a relatively flat side 78 facing the rear rail 34.

Figure 9:
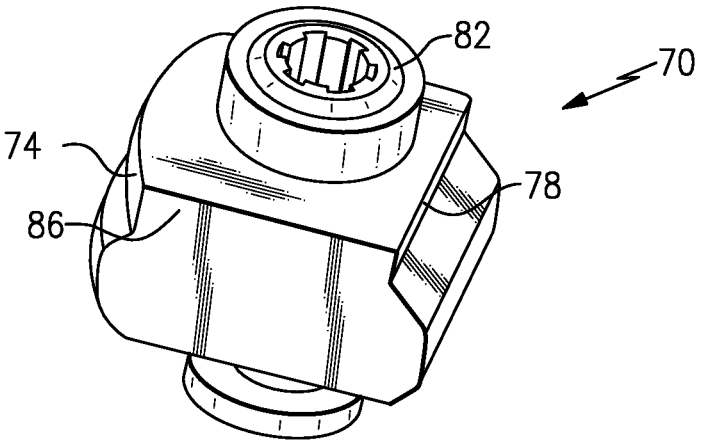
FIG. 9 shows another detail of the lock member.

FIG. 9 shows the lock member 70 having a flat side 78, the curved side 74, and receiving a lock pin, or set screw 82, which is tightened to secure the lock member 70 within the rotor hub 22 once the rotor 20 is fully assembled.

As shown, the curved (or barrel) side 74 is on one side of the lock member 70, with the relatively flat side 78 on the opposite side. Flat side walls 86 extend between the curved side 74 and the flat side 78.

While the disclosed embodiment incorporates both blade and lock slots, rotors coming within the scope of this disclosure could use only one of the two in combination with the relief feature.

Features of the disclosed examples include incorporating a relief feature on an aft rail to enable making the load slot on the forward rail shallower. The relief feature helps balance fatigue life between the two rails. Unlike the load slot, the relief feature does not penetrate the top of the aft rail, which keeps stress concentrations in a lower temperature and lower stress area.

The preceding description is exemplary rather than limiting in nature. Variations and modifications to the disclosed examples may become apparent to those skilled in the art that do not necessarily depart from the essence of this disclosure. Thus, the scope of legal protection given to this disclosure can only be determined by studying the following claims.

We claim:

1. A rotor blade assembling method comprising:

moving a blade into a space between a first rail and a second rail opposing the first rail, the first and second rails extending around a cylindrical surface to define a rotor hub; and moving the blade circumferentially to an installed position within the rotor hub, wherein the blade moves through a blade load slot formed on the first rail and a relief feature formed on the second rail, the relief feature circumferentially aligned with the blade load slot, wherein the second rail has a radially outward facing surface and a radially inward facing surface that meet at an interface, the relief feature formed entirely within the radially inward facing surface such that the relief feature does not extend past the interface.

2. The rotor blade assembling method of claim 1, wherein the relief feature is formed exclusively on a radially inward facing surface of the second rail.

3. The rotor blade assembling method of claim 1, wherein the first rail having the blade load slot is a cold side rail, and the second rail having the relief feature is a hot side rail.

4. The rotor blade assembling method of claim 3, wherein the hot side rail faces a combustion section when the rotor hub is mounted in a turbomachine.

5. The rotor blade assembling method of claim 1, wherein the relief feature is formed on an underside of the second rail.

6. The rotor blade assembling method of claim 1, wherein the radially outward facing surface of the second rail is continuous and uninterrupted by the relief feature.

7. The rotor blade assembling method of claim 1, further comprising using a lock received within a lock slot to hold the blade, the lock slot formed in the first rail circumferentially adjacent to the blade load slot.

8. The rotor blade assembling method of claim 7, wherein the lock includes a curved surface facing a curved surface of the lock slot, and an opposed relatively flat surface facing the second rail.

9. The rotor blade assembling method of claim 1, further comprising moving the blade into the space through the blade load slot and then moving the blade to a position where the blade is circumferentially aligned with adjacent blades.

10. The rotor blade assembling method of claim 1, wherein the rotor hub and blade are constituents of a turbine section rotor.

11. The rotor blade assembling method of claim 1, wherein the blade is disposed entirely outside the relief feature when the blade is in the installed position.

12. The rotor blade assembling method of claim 1, wherein the relief feature is concave.

13. A rotor assembling method comprising:

moving a blade into a space through one of a plurality of blade load slots and one of a plurality of relief features; and moving the blade circumferentially within the space to a position adjacent to other blades, wherein a pair of spaced rails include a first rail and a second rail opposing the first rail, the pair of spaced rails extend around a cylindrical surface to define a rotor hub, and the pair of spaced rails defining the space for receiving blades, wherein the plurality of blade load slots are formed in the first rail, the plurality of blade load slots each extending from an outwardly facing surface of the first rail to an inwardly facing surface of the first rail, wherein the plurality of relief features are formed on an underside of the second rail and are circumferentially aligned with the plurality of blade load slots, wherein the second rail has a radially outward facing surface and a radially inward facing surface that meet at an interface, the relief feature formed entirely within the radially inward facing surface such that the relief feature does not extend past the interface.

14. The rotor assembling method of claim 13, wherein the first rail is a cold side rail when mounted in a turbomachine, and the second rail is a hot side rail when mounted in the turbomachine.

15. The rotor assembling method of claim 14, wherein the second rail faces a combustion section when mounted in the turbomachine.

16. The rotor assembling method of claim 13, wherein a plurality of lock slots are formed in the first rail, the second rail, or both, the method comprising using the plurality of lock slots to move locks in the space, the plurality of blade load slots being utilized to move the blades into the space.

17. The rotor assembling method of claim 16, wherein the locks include a curved surface facing a curved surface of the lock slots, and an opposed relatively flat surface facing the second rail.

18. The rotor assembling method of claim 13, wherein the rotor is a compressor section rotor of a turbomachine.

19. The rotor assembling method of claim 13, wherein the relief feature is concave.

* * * * *